US010312621B2

(12) United States Patent
Yoshioka et al.

(10) Patent No.: US 10,312,621 B2
(45) Date of Patent: Jun. 4, 2019

(54) TERMINAL CONNECTION STRUCTURE

(71) Applicants: Yazaki Corporation, Tokyo (JP); TOYOTA JIDOSHA KABUSHIKI KAISHA, Toyota-shi, Aichi-ken (JP)

(72) Inventors: Toshikazu Yoshioka, Shizuoka (JP); Yasuhiro Tanaka, Shizuoka (JP); Ato Nakano, Toyota (JP)

(73) Assignees: YAZAKI CORPORATION, Minato-ku, Tokyo (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 16/009,866

(22) Filed: Jun. 15, 2018

(65) Prior Publication Data

US 2019/0027854 A1 Jan. 24, 2019

(30) Foreign Application Priority Data

Jul. 20, 2017 (JP) ..... 2017-140600

(51) Int. Cl.

| | |
|---|---|
| ***H01R 13/187*** | (2006.01) |
| ***H01R 13/20*** | (2006.01) |
| ***H01R 13/04*** | (2006.01) |
| ***H01R 13/11*** | (2006.01) |
| ***H01R 13/193*** | (2006.01) |
| *H01R 4/18* | (2006.01) |

(52) U.S. Cl.

CPC ..... *H01R 13/20* (2013.01); *H01R 13/04* (2013.01); *H01R 13/111* (2013.01); *H01R 13/193* (2013.01); *H01R 4/184* (2013.01)

(58) Field of Classification Search

USPC ..... 439/842–858

See application file for complete search history.

(56) References Cited

U.S. PATENT DOCUMENTS

| | | | | |
|---|---|---|---|---|
| 4,919,628 A * | 4/1990 | Mobley | H01R 13/113 | 439/852 |
| 5,151,056 A * | 9/1992 | McClune | H01R 13/114 | 439/851 |
| 5,433,629 A * | 7/1995 | Yagi | H01R 13/187 | 439/843 |

(Continued)

FOREIGN PATENT DOCUMENTS

| | | |
|---|---|---|
| JP | 2005-251741 A | 9/2005 |
| JP | 2011-108595 A | 6/2011 |
| JP | 2013187170 A | 9/2013 |

*Primary Examiner* — Thanh Tam T Le

(74) *Attorney, Agent, or Firm* — Sughrue Mion, PLLC

(57) ABSTRACT

A male terminal metal fitting including a male connector, a female terminal metal fitting including a female connector, and a holding structure that generates holding force therebetween are included. The holding structure includes two first holding bodies that are arranged between the male connector and the female connector in a region and that become contact points therebetween, two second holding bodies that are arranged between the male connector and the female connector in a region and that become contact points therebetween, and a third holding body that is arranged on an opposite side of the first holding bodies in a cylinder axis direction with respect to the second holding bodies and that becomes a contact point between the male connector and the female terminal metal fitting.

7 Claims, 7 Drawing Sheets

(56) References Cited

U.S. PATENT DOCUMENTS

| | | | | |
|---|---|---|---|---|
| 5,630,738 | A * | 5/1997 | Ito | H01R 13/113 439/851 |
| 6,527,600 | B2 * | 3/2003 | Alonso Merino | H01R 13/113 439/842 |
| 6,790,101 | B1 * | 9/2004 | Data | H01R 13/04 439/181 |
| 7,264,518 | B2 * | 9/2007 | Ellis | H01R 4/4818 439/595 |
| 7,381,104 | B2 * | 6/2008 | Rehbein | H01R 13/113 439/852 |
| 8,152,576 | B2 * | 4/2012 | Nakamura | H01R 13/055 439/852 |
| 8,241,075 | B2 * | 8/2012 | Ishikawa | H01R 13/113 439/851 |
| 8,616,924 | B2 * | 12/2013 | Ishida | H01R 13/113 439/851 |
| 8,668,531 | B2 * | 3/2014 | Yamaguchi | H01R 13/187 439/843 |
| 8,784,144 | B2 * | 7/2014 | Hirabayashi | H01R 13/113 439/852 |
| 2001/0051464 | A1 | 12/2001 | Kodama | |
| 2016/0181706 | A1 | 6/2016 | Nakano et al. | |

* cited by examiner

TERMINAL CONNECTION STRUCTURE

CROSS-REFERENCE TO RELATED APPLICATION(S)

The present application claims priority to and incorporates by reference the entire contents of Japanese Patent Application No. 2017-140600 filed in Japan on Jul. 20, 2017.

BACKGROUND OF THE INVENTION

1. Field of the Invention

The present invention relates to a terminal connection structure.

2. Description of the Related Art

Conventionally, a terminal connection structure that physically and electrically connects male and female terminal metal fittings has been known. When the male terminal metal fitting is inserted into a housing completion position in the female terminal metal fitting, the terminal connection structure described here mutually connects the two. The terminal connection structure is disclosed, for example, in Japanese Patent Application Laid-Open No. 2011-108595.

Incidentally, a function of physically and electrically connecting male and female terminal metal fittings and a function of generating holding force between the connected male and female terminal metal fittings are required for a terminal connection structure of this kind. However, a conventional terminal connection structure has a paradoxical relationship in which insertion force between male and female terminal metal fittings is increased when holding force is increased and the holding force is decreased when the insertion force is decreased.

SUMMARY OF THE INVENTION

The present invention is to provide a terminal connection structure that can secure holding force while keeping insertion force low.

A terminal connection structure according to one aspect of the present invention includes a male terminal metal fitting including a columnar or cylindrical male connector; a female terminal metal fitting including a female connector in which a columnar internal space into which the male connector is inserted in an axial direction is provided, and an electric wire connector to which a conductive portion of an electric wire is electrically connected; and a holding structure that is interposed between the male connector, housing of which into the internal space is completed, and the female terminal metal fitting and that generates holding force between the male connector and the female terminal metal fitting, wherein the holding structure includes two first holding bodies that are arranged between the male connector and the female connector in one region of the internal space comparted into two regions in a cylinder axis direction of the female connector and that become contact points between the male connector and the female connector, two second holding bodies that are arranged between the male connector and the female connector in the other region of the comparted internal space and that become contact points between the male connector and the female connector, and a third holding body that is arranged on an opposite side of the first holding bodies in the cylinder axis direction with respect to the second holding bodies and that becomes a contact point between the male connector and the female terminal metal fitting, the first holding bodies are respectively arranged, on a side of one opening of the female connector, in regions formed by further dividing the one region of the internal space into two, the second holding bodies are respectively arranged, on a side of the other opening of the female connector, in regions formed by further dividing the other region of the internal space into two, and the third holding body is arranged in such a manner as to be placed between the first holding bodies when seen in the cylinder axis direction.

According to another aspect of the present invention, in the terminal connection structure, it is preferable that the first holding bodies are protruded from an inner peripheral surface of the female connector on the side of the one opening to be an insertion opening for the male connector, the second holding bodies are protruded from the inner peripheral surface of the female connector, and the third holding body is protruded from the female terminal metal fitting at a position closer to a side of the electric wire connector than the first holding bodies and the second holding bodies.

According to still another aspect of the present invention, in the terminal connection structure, it is preferable that each of the first holding bodies and the second holding bodies has a convex curve surface to be a contact point.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
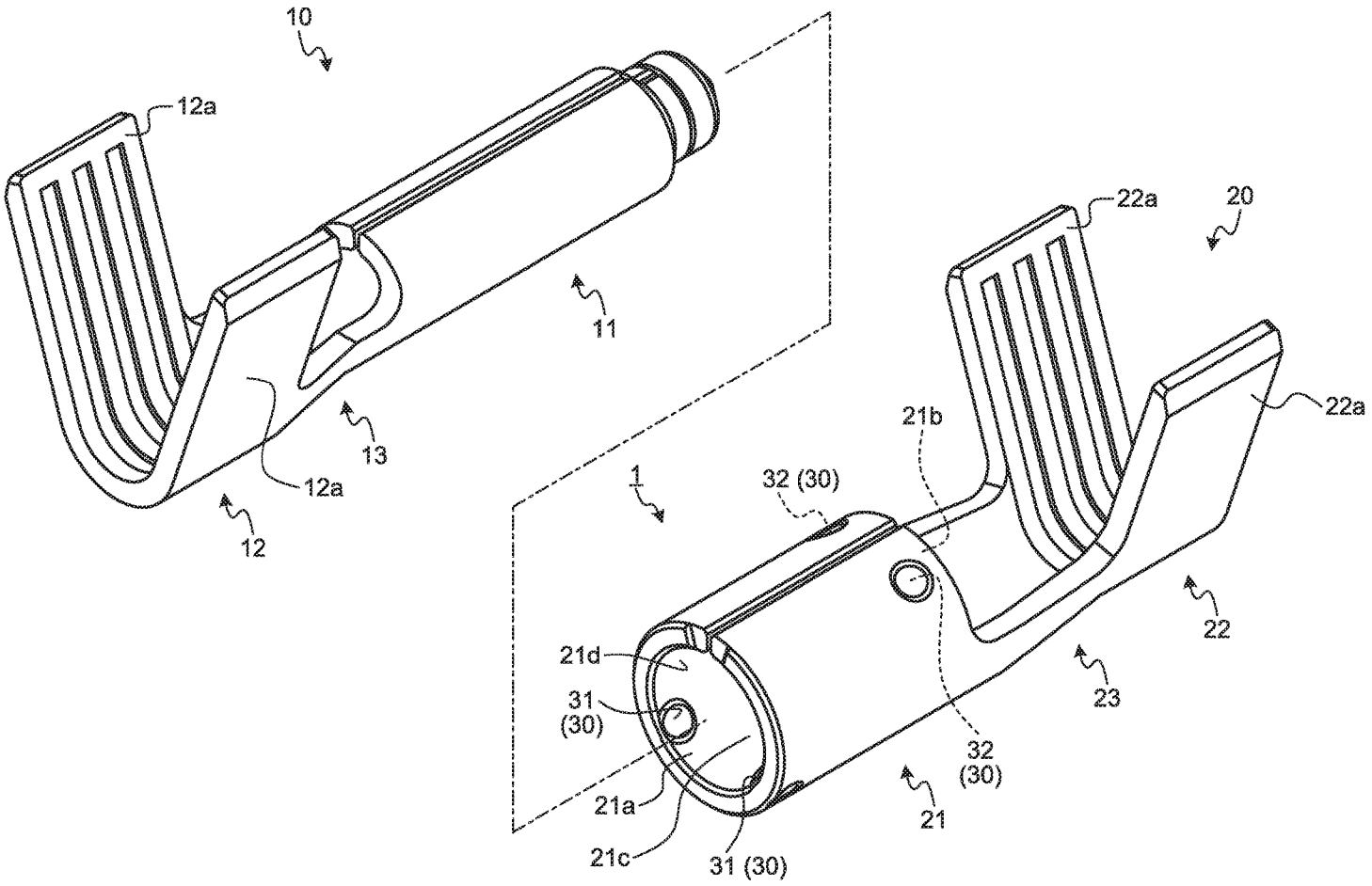
FIG. 1 is a perspective view illustrating a terminal connection structure of an embodiment and illustrating a state before a male terminal metal fitting and a female terminal metal fitting are connected.

In the following, an embodiment of a terminal connection structure according to the present invention will be described in detail on the basis of the drawings. Note that this invention is not limited to this embodiment.

Embodiment

One of embodiments of a terminal connection structure according to the present invention will be described on the basis of FIG. 1 to FIG. 8.

A sign 1 in FIG. 1 to FIG. 5 indicates a terminal connection structure of the present embodiment. This terminal connection structure 1 relates to connection between a male terminal metal fitting 10 and a female terminal metal fitting 20 in the following. This terminal connection structure 1 includes a holding structure 30 that generates holding force between the male terminal metal fitting 10 and the female terminal metal fitting 20.

Figure 2:
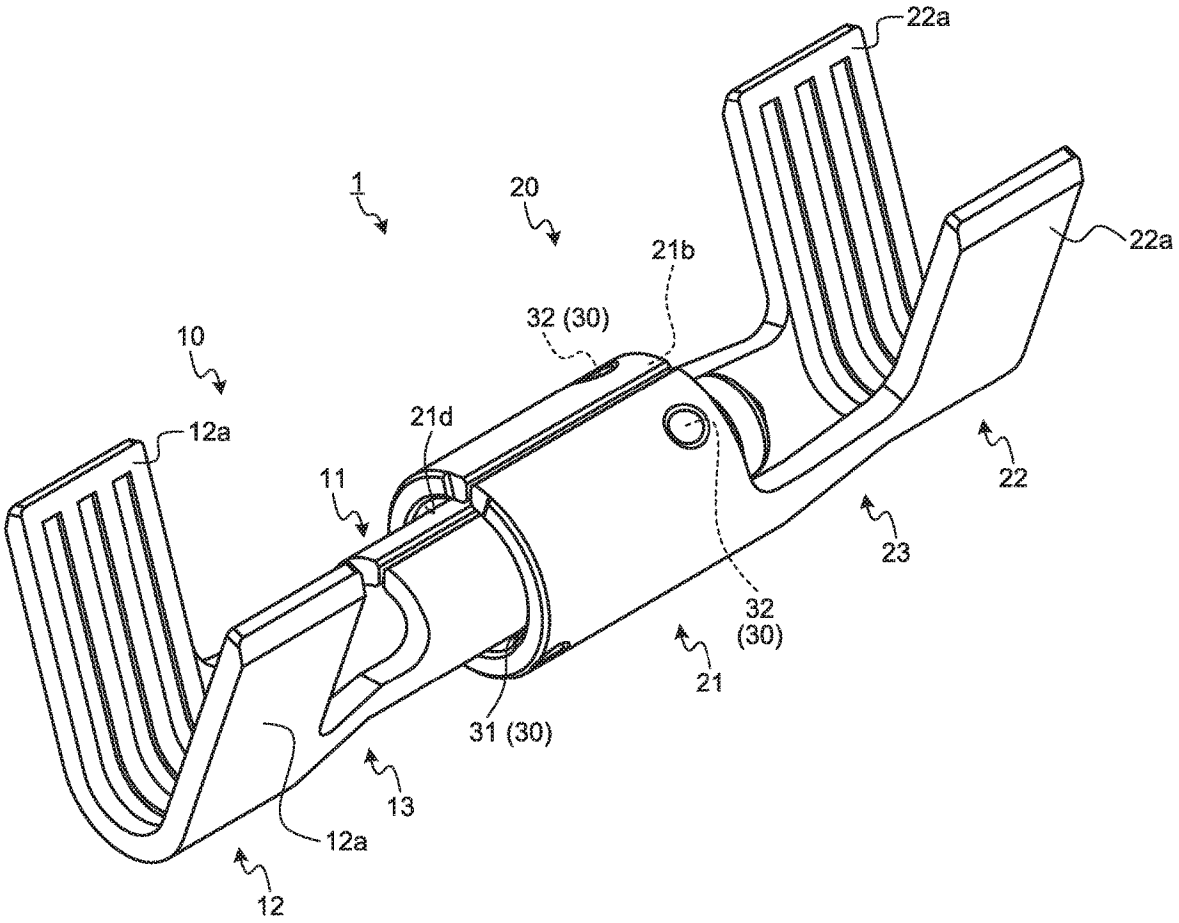
FIG. 2 is a perspective view illustrating the terminal connection structure of the embodiment and illustrating a state after the male terminal metal fitting and the female terminal metal fitting are connected.

The male terminal metal fitting 10 includes a conductive material such as metal. For example, this male terminal metal fitting 10 is formed by press working such as cutting or bending with a conductive metallic plate as a base material. The male terminal metal fitting 10 may be formed by a method other than the press working such as by cutting. This male terminal metal fitting 10 includes a male connector 11, an electric wire connector 12, and a coupler 13 (FIG. 1 and FIG. 2).

The male connector 11 is formed in a columnar or cylindrical shape. In the male terminal metal fitting 10, an axial direction of this male connector 11 is an insertion/removal direction with respect to the female terminal metal fitting 20.

The electric wire connector 12 is a portion to which a conductive portion of an electric wire (not illustrated) is electrically connected. The connection can be anything such as that by crimping such as swaging, that by welding, or that by soldering. In this example, a U-shaped electric wire connector 12 is formed by bending of a plate-shaped base material. The electric wire connector 12 includes two barrel pieces 12*a* facing each other. Each of the barrel pieces 12*a* is wound around a core wire of an electric wire as a conductive portion and is crimped to the conductive portion, whereby physical and electrical connection to this conductive portion is made.

The coupler 13 is a portion interposed between the male connector 11 and the electric wire connector 12 and connects these.

The female terminal metal fitting 20 includes a conductive material such as metal. For example, this female terminal metal fitting 20 is formed by press working such as cutting or bending with a conductive metallic plate as a base material. The female terminal metal fitting 20 may be formed by a method other than the press working such as by cutting. This female terminal metal fitting 20 includes a female connector 21, an electric wire connector 22, and a coupler 23 (FIG. 1 and FIG. 2).

An outer shape of the female connector 21 is not limited but is formed cylindrically according to the columnar or cylindrical male connector 11. Both ends in a cylinder axis direction of the female connector 21 are opened. An opening at one end (hereinafter, referred to as "first opening") 21*a* is used as an insertion opening for the male connector 11 (male terminal insertion opening) and is also used as a removal opening of when the male connector 11 is removed (male terminal removal opening). In this example, the male connector 11 inserted from the first opening 21*a* is protruded from an opening at the other end (hereinafter, referred to as "second opening") 21*b*. This female connector 21 includes a columnar internal space 21*c* in which the male connector 11 is inserted and housed in the axial direction.

The electric wire connector 22 is a portion to which a conductive portion of an electric wire (not illustrated) is electrically connected. The connection can be anything such as that by crimping such as swaging, that by welding, or that by soldering. In this example, a U-shaped electric wire connector 22 is formed by bending of a plate-shaped base material. The electric wire connector 22 includes two barrel pieces 22*a* facing each other. Each of the barrel pieces 22*a* is wound around a core wire of an electric wire as a conductive portion and is crimped to the conductive portion, whereby physical and electrical connection to this conductive portion is made.

The coupler 23 is a portion interposed between the female connector 21 and the electric wire connector 22 and connects these.

The holding structure 30 is interposed between the male connector 11, which is housed in the internal space 21*c*, and the female terminal metal fitting 20 and is configured to generate holding force between the male connector 11 and the female terminal metal fitting 20. Also, this holding structure 30 electrically connects the male connector 11 and the female terminal metal fitting 20.

Figure 3:
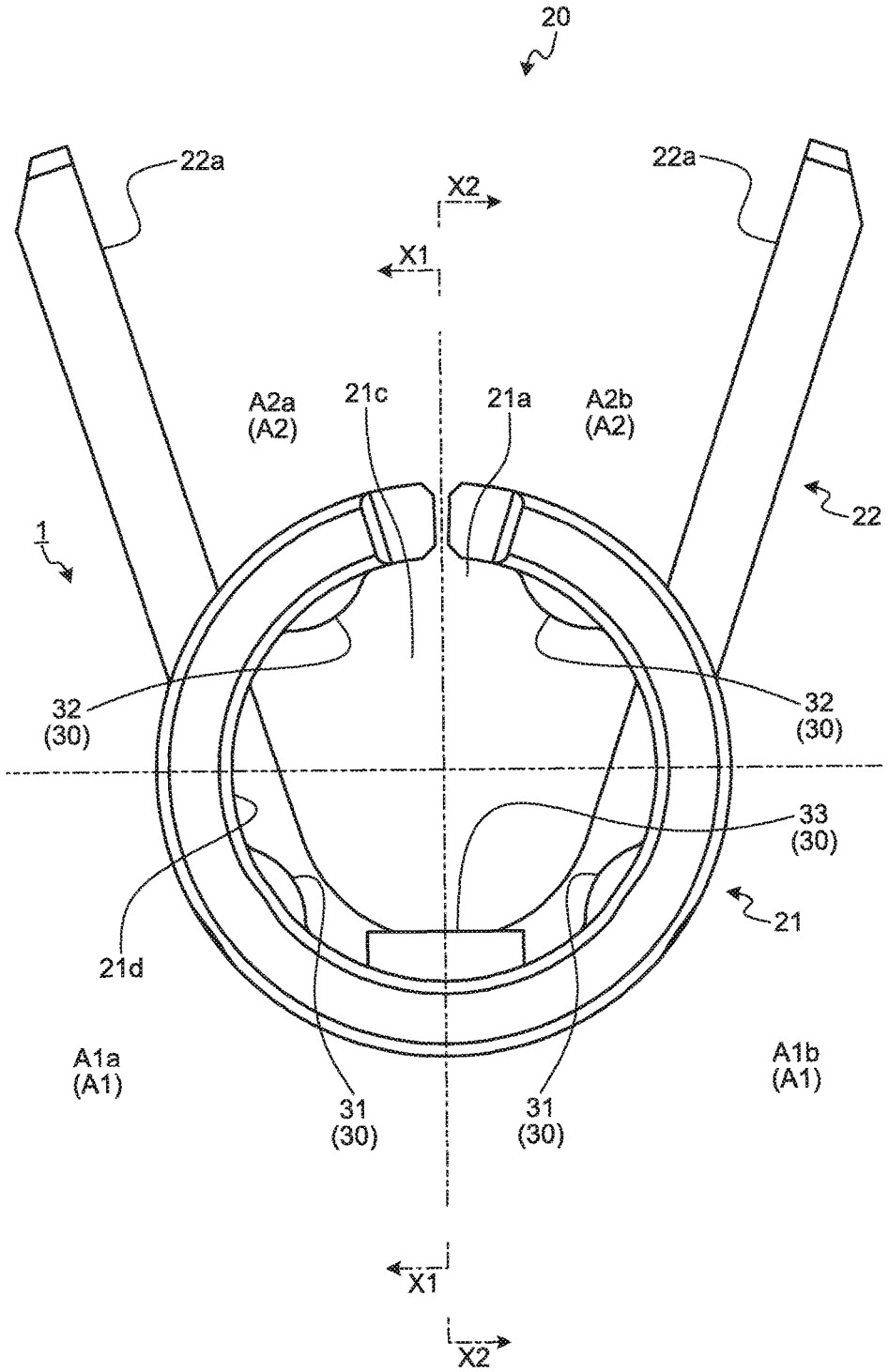
FIG. 3 is a front view of the female terminal metal fitting.
Figure 4:
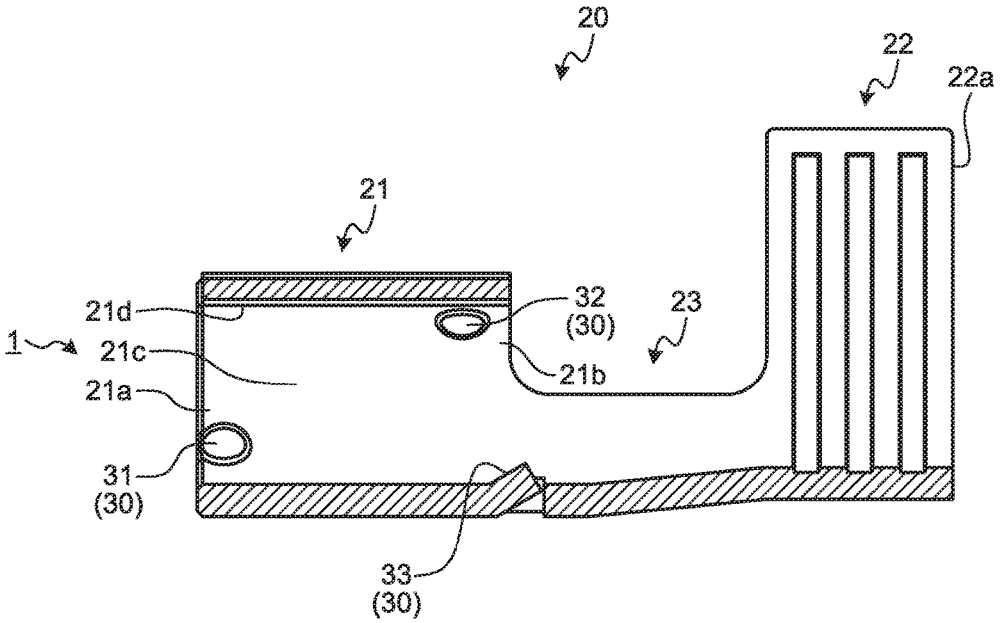
FIG. 4 is an X1-X1 sectional view of FIG. 3.
Figure 5:
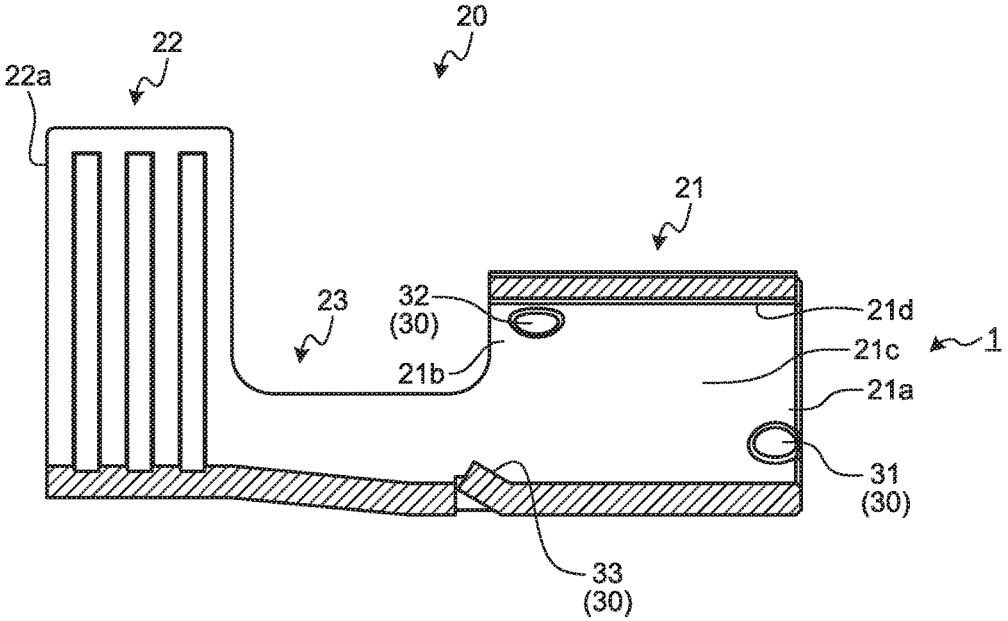
FIG. 5 is an X2-X2 sectional view of FIG. 3.

This holding structure 30 includes two first holding bodies 31, two second holding bodies 32, and one third holding body 33 (FIG. 3 to FIG. 5). The first holding bodies 31, the second holding bodies 32, and the third holding body 33 may be provided in the male connector 11 or the female terminal metal fitting 20. Here, a case where these are provided in the female terminal metal fitting 20 will be described as an example.

The first holding bodies 31 are arranged between the male connector 11 and the female connector 21 in one region of the internal space 21*c* comparted into two regions A1 and A2 (FIG. 3) in the cylinder axis direction of the female connector 21. Each of these first holding bodies 31 creates a holding state between the male connector 11 and the female connector 21, and becomes a contact point between the male connector 11 and the female connector 21. Here, the first holding bodies 31 are arranged in the region A1. More specifically, the first holding bodies 31 are respectively arranged in regions A1*a* and A1*b* that are formed by further dividing the region A1 into two. Also, the first holding bodies 31 are arranged on a side of one opening of the female connector 21. Here, the first holding bodies 31 are arranged on a side of the first opening 21*a* to be an insertion opening for the male connector 11.

The first holding bodies 31 of this example are protruded from an inner peripheral surface 21*d* of the female connector 21 on a side of the first opening 21*a* in the region A1. Each of these first holding bodies 31 is formed as an expanded body expanded from the inner peripheral surface 21*d* and has a convex curve surface to be a contact point with respect to the male connector 11. Here, a spherical expanded body is used as each of the first holding bodies 31. Note that a shape of each of the first holding bodies 31 is not necessarily a convex curve surface, and may have a shape other than the convex curve surface as long as a function thereof can be performed.

The second holding bodies 32 are arranged between the male connector 11 and the female connector 21 in the other region of the comparted internal space 21*c*. Similarly to the first holding bodies 31, each of these second holding bodies 32 creates a holding state between the male connector 11 and the female connector 21, and becomes a contact point between the male connector 11 and the female connector 21. Here, the second holding bodies 32 are arranged in the region A2. More specifically, the second holding bodies 32 are respectively arranged in regions A2*a* and A2*b* that are formed by further dividing the region A2 into two (FIG. 3). Also, the second holding bodies 32 are arranged on a side of the other opening of the female connector 21. Here, the second holding bodies 32 are arranged on a side of the second opening 21*b*.

The second holding bodies 32 of this example are protruded from the inner peripheral surface 21*d* of the female connector 21 on a side of the second opening 21*b* in the region A2. Similarly to the first holding bodies 31, each of these second holding bodies 32 is formed as an expanded body expanded from the inner peripheral surface 21*d* and has a convex curve surface to be a contact point with respect to the male connector 11. Here, a spherical expanded body is used as each of the second holding bodies 32.

The third holding body 33 is arranged on an opposite side of the first holding bodies 31 in the cylinder axis direction of the female connector 21 with respect to the second holding bodies 32. The third holding body 33 of this example is arranged closer to a side of the electric wire connector 22 than the first holding bodies 31 and the second holding bodies 32. Moreover, this third holding body 33 is arranged in such a manner as to be placed between the first holding bodies 31 when seen in the cylinder axis direction of the female connector 21. This third holding body 33 creates a holding state between the male connector 11 and the female terminal metal fitting 20, and becomes a contact point between the male connector 11 and the female terminal metal fitting 20.

The third holding body 33 of this example is protruded from the female terminal metal fitting 20 at a position closer to the side of the electric wire connector 22 than the first holding bodies 31 and the second holding bodies 32. Here, the third holding body 33 is provided from a side of the second opening 21*b* on the inner peripheral surface 21*d* of the female connector 21 to the coupler 23. Similarly to the first holding bodies 31 or the second holding bodies 32, this third holding body 33 may be formed as an expanded body expanded toward the male connector 11. In this case, the third holding body 33 has a convex curve surface to be a contact point with respect to the male connector 11, and a spherical expanded body can be used as the third holding body 33. Also, the third holding body 33 may be a cantilever piece that is formed in press forming of the female terminal metal fitting 20 and that is bent from a side of a base. In this example, a third holding body 33 in a shape of the piece is provided. This third holding body 33 in the shape of the piece has elasticity with the base thereof as an origin, and can apply pressing force associated with reaction force thereof to the male connector 11 when being elastically deformed by the male connector 11. That is, this third holding body 33 in the shape of the piece contributes to improvement of holding force between the male connector 11 and the female terminal metal fitting 20.

In this terminal connection structure 1, when insertion of a leading end of the male connector 11 from the first opening 21*a* into the internal space 21*c* of the female connector 21 is started, the male connector 11 comes into contact with the two first holding bodies 31 and is supported thereby. This state is kept until the male connector 11 comes into contact with the two second holding bodies 32. Thus, frictional resistance applied to the male connector 11 is generated between this and the two first holding bodies 31 until the male connector 11 comes into contact with the two second holding bodies 32. Thus, in this terminal connection structure 1, the male connector 11 can be inserted into the female connector 21 with low insertion force since the frictional resistance is low until the male connector 11 comes into contact with the two second holding bodies 32. Specifically, in this example, since the convex curve surfaces of the first holding bodies 31 are in contact with the male connector 11, the frictional resistance can be further decreased and the male connector 11 can be inserted into the female connector 21 with lower insertion force.

Figure 6:
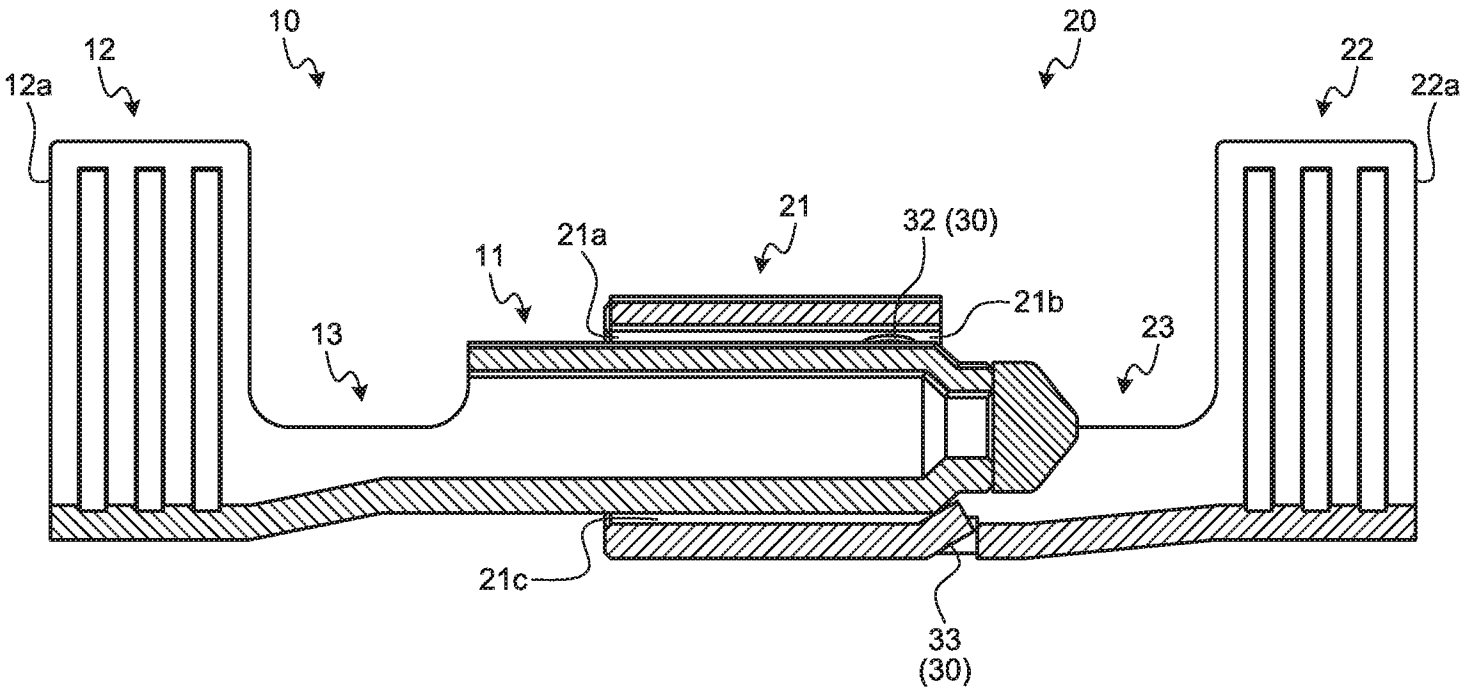
FIG. 6 is a sectional view illustrating an example of a state in which housing of a male connector into a female connector is completed.

In this terminal connection structure 1, the male connector 11 comes into contact with the two second holding bodies 32 in a final stage of the process of inserting the male connector 11 into the female connector 21, and the male connector 11 comes into contact with the third holding body 33 in an appropriate period (FIG. 6). That is, in this terminal connection structure 1, the frictional resistance applied to the male connector 11 becomes high in the final stage of the process of inserting the male connector 11 into the female connector 21. Thus, operation of inserting the male connector 11 with low insertion force can be performed in this terminal connection structure 1. On the other hand, in this terminal connection structure 1, when housing of the male connector 11 into the female connector 21 is completed, the male connector 11 is in contact with the two first holding bodies 31, the two second holding bodies 32, and the one third holding body 33 and is supported thereby. Thus, in this terminal connection structure 1, the holding force between the male connector 11 and the female terminal metal fitting 20 is increased when housing of the male connector 11 into the female connector 21 is completed. Moreover, in the terminal connection structure 1 of this example, since reaction force (pressing force) is applied from the elastically-deformed third holding body 33 to the male connector 11, higher holding force can be generated.

Note that the male connector 11 is supported by the two first holding bodies 31 and is inclined until coming into contact with the two second holding bodies 32. Thus, there is a possibility that a leading end also comes into contact with the inner peripheral surface 21*d* of the female connector 21 or a side of the first opening 21*a* also comes into contact with a periphery or the like of the internal space 21*c*. However, in this terminal connection structure 1, an increase in the frictional resistance due to an increase in contact parts of the male connector 11 is insignificant. It is possible to insert the male connector 11 into the female connector 21 with low insertion force until the male connector 11 comes into contact with the two second holding bodies 32.

Figure 7:
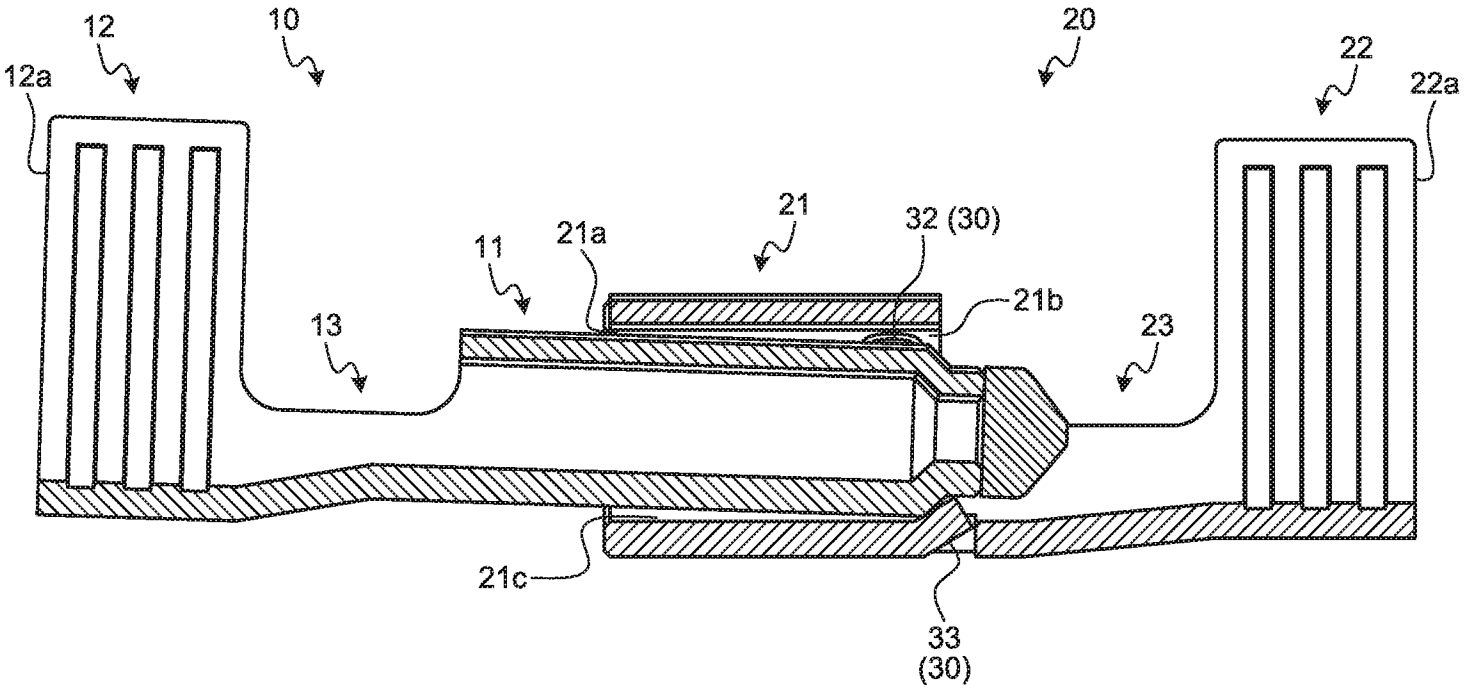
FIG. 7 is a sectional view illustrating an example of a state in which housing of the male connector into the female connector is completed.

FIG. 7 is a view illustrating a housing completion state of the male connector 11 in a case where the leading end is inclined toward the inner peripheral surface 21*d* on a side of the region A1. In this case, for example, the male connector 11 slid on the inner peripheral surface 21*d* pushes the third holding body 33 and elastically deforms this third holding body 33, whereby reaction force (pressing force) is applied from the third holding body 33 to the male connector 11. Thus, in this case, although an insertion amount of the male connector 11 is smaller than that of the example in FIG. 6, the male connector 11 is held by the two first holding bodies 31, the two second holding bodies 32, and the one third holding body 33.

Figure 8:
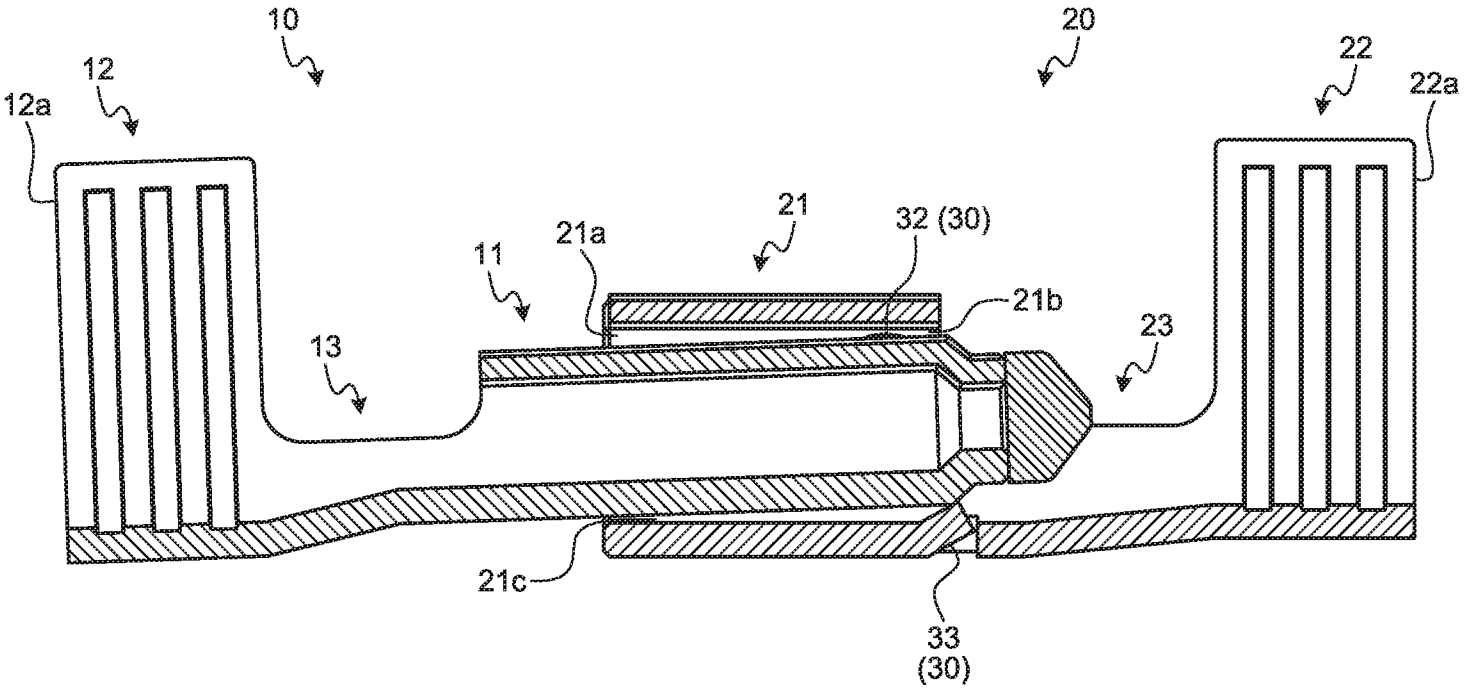
FIG. 8 is a sectional view illustrating an example of a state in which housing of the male connector into the female connector is completed.

Also, FIG. 8 is a view illustrating a housing completion state of the male connector 11 in a case where the leading end is inclined toward the inner peripheral surface 21*d* on a side of the region A2 or a case where the male connector 11 is further pushed from the housing completion position in FIG. 6. In these cases, for example, the male connector 11 pushes and elastically deforms the third holding body 33, whereby reaction force (pressing force) is applied from the third holding body 33 to the male connector 11. Thus, in these cases, although an insertion amount of the male connector 11 is larger than that of the example in FIG. 6, the male connector 11 is held by the two first holding bodies 31, the two second holding bodies 32, and the one third holding body 33. However, in these cases, the male connector 11 is in an inclined state due to the reaction force from the third holding body 33.

As described above, while keeping insertion force of when the male connector 11 is inserted into the female connector 21 low, the terminal connection structure 1 of the present embodiment can secure holding force between the male connector 11 and the female terminal metal fitting 20 of when housing of the male connector 11 into the female connector 21 is completed.

Here, in a case where a holding structure 30 is provided in a male connector 11, two first holding bodies 31, two second holding bodies 32, and one third holding body 33 are serially arranged from a side of a leading end of the male connector 11. In an arrangement of these, the male connector 11 is divided into four regions in an axial direction similarly to the female connector 21, and the two first holding bodies 31, the two second holding bodies 32, and the one third holding body 33 are distributed to these regions similarly to the foregoing example. An effect similar to that of the foregoing example can be acquired even when a terminal connection structure 1 is configured in such a manner.

Also, in this terminal connection structure 1, an elastic member (not illustrated) that applies force in a direction of connection operation between a male connector 11 and a female connector 21 may be provided in at least one of a male terminal metal fitting 10 and a female terminal metal fitting 20. In this terminal connection structure 1, with force from the elastic member, insertion force of the male connector 11 can be further decreased and holding force between the male connector 11 and the female terminal metal fitting 20 can be further increased. Also, in this terminal connection structure 1, a contact load necessary for securing electrical conduction between the male terminal metal fitting 10 and the female terminal metal fitting 20 can be generated in first holding bodies 31, second holding bodies 32, and a third holding body 33.

In a terminal connection structure according to the present embodiments, with arrangements of two first holding bodies, two second holding bodies, and a third holding body, it is possible to keep insertion force of when a male connector is inserted into a female connector low and to secure holding force between the male connector and a female terminal metal fitting of when housing of the male connector into the female connector is completed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal connection structure comprising:

a male terminal metal fitting including a columnar or cylindrical male connector;

a female terminal metal fitting including a female connector in which a columnar internal space into which the male connector is inserted in an axial direction is provided, and an electric wire connector to which a conductive portion of an electric wire is electrically connected; and a holding structure that is interposed between the male connector, housing of which into the internal space is completed, and the female terminal metal fitting and that generates holding force between the male connector and the female terminal metal fitting, wherein the holding structure includes two first holding bodies that are arranged between the male connector and the female connector in a first region of the internal space comparted into two regions in a cylinder axis direction of the female connector and that become contact points between the male connector and the female connector, two second holding bodies that are arranged between the male connector and the female connector in a second region of the internal space and that become contact points between the male connector and the female connector, and a third holding body that is arranged on an opposite side of the first holding bodies in the cylinder axis direction with respect to the second holding bodies and that becomes a contact point between the male connector and the female terminal metal fitting, the first holding bodies are respectively arranged, on a side of one opening of the female connector, in the two regions of the first region, the second holding bodies are respectively arranged, on a side of another opening of the female connector, in two regions formed by dividing the second region of the internal space into two, and the third holding body is arranged in such a manner as to be placed between the first holding bodies when seen in the cylinder axis direction of the female connector, wherein the two regions of the first region and the two regions of the second region are regions that are positioned, in a non-overlapping manner in respective radial directions, around an axis extending in the cylinder axis direction.

2. The terminal connection structure according to claim 1, wherein the first holding bodies are protruded from an inner peripheral surface of the female connector on the side of the one opening to be an insertion opening for the male connector, the second holding bodies are protruded from the inner peripheral surface of the female connector, and the third holding body is protruded from the female terminal metal fitting at a position closer to a side of the electric wire connector than the first holding bodies and the second holding bodies.

3. The terminal connection structure according to claim 1, wherein each of the first holding bodies and the second holding bodies has a convex curve surface to be a contact point.

4. The terminal connection structure according to claim 2, wherein each of the first holding bodies and the second holding bodies has a convex curve surface to be a contact point.

5. The terminal connection structure according to claim 1, wherein the first holding bodies are arranged between the male connector and a bottom side of the female connector, and the second holding bodies are arranged between the male connector and a top side of the female connector.

6. The terminal connection structure according to claim 2, wherein the third holding body is configured to protrude from the female terminal metal fitting at a position closer to the electric wire connector, in the cylinder axis direction, than the first holding bodies and the second holding bodies before the male connector is inserted into the female connector.

7. The terminal connection structure according to claim 2, wherein the holding structure is positioned such that the male connector contacts the first holding bodies and the second holding bodies before contacting the third holding body, when the male connector is inserted into the female connector.

* * * * *